US006255574B1

(12) United States Patent
Sapienza

(10) Patent No.: US 6,255,574 B1
(45) Date of Patent: Jul. 3, 2001

(54) SINGLE AND DOUBLE BEAT BASE PEDAL

(76) Inventor: Joseph Sapienza, 20 E. Royal Pkwy., Williamsville, NY (US) 14221

( * ) Notice: Subject to any disclaimer, the term of this patent is extended or adjusted under 35 U.S.C. 154(b) by 0 days.

(21) Appl. No.: 09/703,214

(22) Filed: Oct. 31, 2000

(51) Int. Cl.[7] ..... G10D 13/02
(52) U.S. Cl. ..... 84/422.1; 84/422.1; 84/422.2; 84/422.3
(58) Field of Search ..... 84/422.1, 422.2, 84/422.3

(56) References Cited

U.S. PATENT DOCUMENTS 1,369,233 * 2/1921 Fitzgerald et al. ..... 84/422.1
4,520,710 * 6/1985 Elliott, Jr. ..... 84/422.1
5,591,929 * 1/1997 Wellman ..... 84/422.1
5,990,401 * 11/1999 Braun et al. ..... 84/422.1

FOREIGN PATENT DOCUMENTS

225275 * 6/1987 (EP) .
2172137 * 9/1986 (GB) .

* cited by examiner

*Primary Examiner*—Bentsu Ro
*Assistant Examiner*—S Hsieh
(74) *Attorney, Agent, or Firm*—James J. Ralabate

(57) ABSTRACT

This invention involves a device to be used with a bass drum. The device has two foot pedals with a mallet attached to each pedal. The user can step on one first foot pedal which has an overlapping portion over the second foot pedal to cause a two beat contact with the drum. The user can also just step on the second foot pedal for a single contact of the mallet with the drum.

18 Claims, 4 Drawing Sheets

SINGLE AND DOUBLE BEAT BASE PEDAL

This invention relates to a drum beater device and, more specifically, to a device where a single or, alternatively, a double beat can be imparted to a bass or other drum. In the present invention, the drummer can activate one or both beaters.

BACKGROUND OF THE INVENTION

It is known for drummers to use two separate drums with a foot pedal for each drum to impart a beat not possible when playing only one drum. There are also devices known for imparting various sounds to an adjacent drum where the same device is used with only one drum and one foot pedal. Some of these double acting drum pedals are disclosed and discussed in U.S. Pat. Nos. 3,618,441; 4,188,853; 5,090, 289; 5,204 485; 5,877,441; 5,990,401; and 6,002,076.

In Fearns U.S. Pat. No. 3,618,441 a double acting drum pedal is disclosed where a shaft is rotably mounted on a stand. This is a heel-toe process; mechanically, this design will not give off two beats when the user pushes his toe down and then pushes his heel down. Connecting the shaft and the end of the pedal are means for rotating the shaft in one direction upon rocking of the pedal in either direction so that the beater is moved into the drum beating position upon a rocking movement of the pedal. Fearns uses one pedal and one mallet or beater 19 to accomplish his two sound objectives. Fearns describes his invention as follows: "A double acting bass drum pedal has a beater mounted on a horizontal shaft with there being an arm also mounted on said shaft but offset from the rotary axis thereof and directed downwardly toward an end of a rockably mounted pedal. A flexible strip connects the arm to the end of the pedal so that rocking of the pedal in either direction will rotate the shaft in one direction to bring the beater into the drum beating position."

In U.S. Pat. No. 4,188,853 (Bills) a multi-purpose double acting drum pedal is disclosed wherein the toe must be lifted in order to achieve two beats. Bills' two mallets or beaters 16 and 18 in an inactive position are a few inches from the drumhead. Since they travel only a few inches from stop to hitting the drums, the sound will not be as pronounced as when the mallets move a greater distance before hitting the drum head. The two mallets 16 and 18 of Bills are only offset at about 30° so that the difference in contact time is relatively short and somewhat harder to control. Thus, when Bills' pedal 25 is depressed, it is limited to about a 30° arc when striking the bass drum. This does not afford adequate force when striking the drum, therefore could result in an undesirable muffled bass sound. A design which allows a greater arc such as about a 60° arc would result in a more definite sound and more desirable effect. Bills' apparatus relies upon a single pedal to create a double pedal sound but requires the user to operate a toe clip 25(*a*) to enable the user to cause the mallet to strike the drum head with a desired controlled force. Therefore, Bills uses a single foot pedal with two mallets 16 and 18 and a toe clip 25(*a*) to control the force of each mallet impact. Two features of Bills that could be improved upon are the short arc and the required toe clip usage. Bills description of his drum pedal is "A double acting drum beater device is provided having a beater adapted to strike an adjacent drumhead once for each downward movement of a foot operated pedal, and then a second time during the subsequent upward movement of the pedal. My drum beater device comprises a beater arm arranged to swing in an arc about a rotatable axis defined by a shaft supported by mounting means, which shaft is arranged to undertake oscillatory type movements. A food pedal having up and down operative movements is mounted adjacent the mounting means and linkage means connects a toe portion of the foot pedal to an arm secured to the shaft in an offset relation. In this way, up and down movements of the toe portion of the pedal cause the connecting linkage and the arm to move responsively and thus cause the shaft to oscillate, with the shaft rotating in a first direction and then in the opposite direction about its longitudinal axis during downward movement of the pedal. Advantageously, the relationship between pedal, linkage, and beater are such that the beater is caused by such shaft oscillations to strike an adjacent drumhead twice for each up-down cycle of the pedal. This basic teaching readily lends itself to incorporation into a double beater arrangement in which a pair of beaters strike an associated drumhead in offset relation."

Holcomb U.S. Pat. No. 5,090,289 discloses a double action pedal-activated beater that provides multiple beats for each completed cycle of a foot operated pedal. In Holcomb, there is a 10° arc from the mallet to the bass drum which results in a less definite sound. The heel of Holcomb does not sit on the floor, thereby making his device somewhat unstable. Holcomb's device delivers two beats of a percussion instrument per one cycle of a foot pedal by employing a linkage between the pedal and the beater and a cam for delivering another beat during the cycle. Holcomb uses one pedal and a cam with one mallet 28. Holcomb describes his invention as "A double action pedal-activated beater assembly is provided for a percussion instrument. The beater mechanism provides multiple beats of the percussion instrument for each completed cycle of a foot operated pedal. One beat is provided by rotational movement of the rotatable beater assembly through a linkage between the beater assembly and one end of the foot operated pedal. Another beat is provided by the interaction of a cam surface located on the foot operated pedal with a cam contacting surface on the rotatable beater assembly. This construction provides a durable and simple beater mechanism which yields two beater strokes per cycle of a foot pedal, each at any desired power level.

Lombardi U.S. Pat. No. 5,204,485 uses a two separate pedal arrangement with two mallets 21 and 22 attached thereto. The mallets 21 and 22 are adjacent the drum head 40 but are operated independently by separated foot pedals 31 and 91. This double bass apparatus requires the drummer to use both feet or both separated pedals independently, whereas in the present invention the double base pedal will eliminate the use of two feet. Lombardi has "A drum beating assembly comprising a first frame including first pedestal structure, first, second, and third bearings carried by the first pedestal structure, in spaced coaxial relation; a primary axle carried by the first and third bearings, and a primary drum beater carried by the primary axle; a secondary axle carried by the second and third bearings; and a secondary drum beater carried by the secondary axle; the primary and secondary axles being independently rotatable, there being a first pedal operatively connected to the primary axle to rotate the primary axle and primary drum beater in response to pedal pivoting, the secondary axle and secondary drum beater being rotatable by auxiliary structure, adjustably positioned relative to the first frame, and a first base plate integrally supporting the first pedestal structure, the first plate also supporting the first pedal for pivoting relative thereto.

Labute U.S. Pat. No. 5,877,441 teaches the use of a drum percussion device having a front pedal 80 and a back peddle 28 similar to the heel-toe application used by Ferns and Karn discussed herein. The back peddle 28 would be close to the heel of the user while front pedal 80 would be closer to the toe of the user. Each pedal is connected to beaters 14 and 16. Back pedal 28 causes heater 16 to hit the drum while front pedal 80 causes beater 14 to hit the drum. The front and back pedal portions abut each other and can be difficult to selectively push. In operation, the toe and heel pressure needed to selectively operate this drum percussion device can be somewhat awkward and requires concentration and caution. Also, the offset of each beater or mallet 14 and 16 to each other is not dealt with by Labute, but this is a very important aspect of this type of device.

Braun U.S. Pat. No. 5,990,401 discloses a dual foot pedal assembly for a drum beater which utilizes two widely spaced foot pedals to operate mallets 14*a* and 14 in a similar application as Lombard earlier discussed. It takes two feet to operate Braun's device since pedals 12 and 40 are widely spaced from each other. Also, the mallets 14*a* and 14 used by Braun are substantially in the same position when at rest. Braun's description of his invention is "An apparatus for use with a percussion instrument assembly includes a base unit for positioning on a preselected surface. A first instrument pedal includes a first connecting linkage having a first end and a second end. The first end of the first connecting linkage is linked to the base unit so that the first instrument pedal may be utilized to operate a first percussion instrument. A second instrument pedal is positioned adjacent the first instrument pedal. The second instrument pedal includes a second connecting linkage having a first end and a second end. The first end of the second connecting linkage is linked to the base unit so that the second instrument pedal may be utilized to operate a second percussion instrument in a manner such that the first and second pedals are capable of being alternately actuated independently and simultaneously by the foot of an operator to respectively activate one or more the first and second percussion instruments. A quick release mechanism is provided so that the first instrument pedal may be rapidly engaged and disengaged, respectively, with a third instrument pedal.

Karn U.S. Pat. No. 6,002,076 like Labute, above discussed, uses a front-back drum pedal system for actuating two drum beaters 80, which requires unnatural use of the toe and heel of user. The pedal is split into a toe and heel portion, each independently connected to a beater oriented adjacent a drum head. The user may independently actuate one or both beaters. Again, beaters 80 of Karn are both located at the same position when the device is at rest. A disadvantage can be that using a toe-heel control pedal can be awkward and requires a great deal of skill to control.

SUMMARY OF THE INVENTION

It is therefore an object of this invention to provide a double strike drum mechanism devoid of the above-noted disadvantages.

Another object of this invention is to provide a drum full foot pedal system for independently actuating either one or two drum beaters.

Still another object of this invention is to provide a simple, easy to use drum pedal system that is consistent with conventional usage by drummers.

Yet another object of this invention is to provide a drum pedal system where the mallets are offset from each other by at least 100°.

A further object of this invention is to provide a drum pedal system where the distance of each mallet from the drum is significant, thereby allowing a more than adequate striking force to produce a quality sound.

Still yet another object of this invention is to provide a drum pedal system where the mallets arc easily controlled by separate side-by-side full foot pedals.

These and other objects of this invention are accomplished by a percussion device for use with a drum to allow a user with one foot to hit the drum with one or two mallets. The device has a base having two side-by-side full foot pedals, each pedal attached to its own mallet. "Full foot" pedals as opposed to toe and heel type pedals permit better foot control. One of the pedals has a connecting bar connected to one pedal ("connected pedal") that overlaps over the second pedal ("unconnected pedal") so that if the connected pedal is depressed by the user, both pedals will be depressed simultaneously. If only one pedal and mallet is desired to be used, only the unconnected pedal is depressed, thus allowing only one beater or mallet to strike the drum. There is a connector at the base of the device for connection to the bass drum. Each pedal is connected to a chain and sprocket and a spring for tension to allow depression and return of the pedal being pushed. Two beaters may be used to achieve a desired percussion sound, such as for Latin beats or other desired sounds. This gives a continuous double beat, if desired. When both pedals are depressed, the mallets hit the drum a different time about 100°–180° off time from each other. The longer the arc of the mallet, the greater flexibility the drummer has to accomplish the desired sound. There are at least four important features to the present invention:

(1) the mallets must be positioned at least 100° offset from each other when the device is at rest.

(2) The pedals are full foot, side-by-side pedals with a connecting bar that allows one or both pedals to be easily depressed.

(3) The mallets, when both are simultaneously used, strike the drum head about 100°–180° off time from each other.

(4) The distance of the furthermost mallet from the drum head must be at an angle (from drum head to mallet) of greater than 45°.

By utilizing a drum pedal system with all four of the above features, better sound control with a more definite sound is achieved and, most importantly, more variation in sound can be accomplished.

DETAILED DESCRIPTION OF THE DRAWING AND PREFERRED EMBODIMENTS

Figure 1:
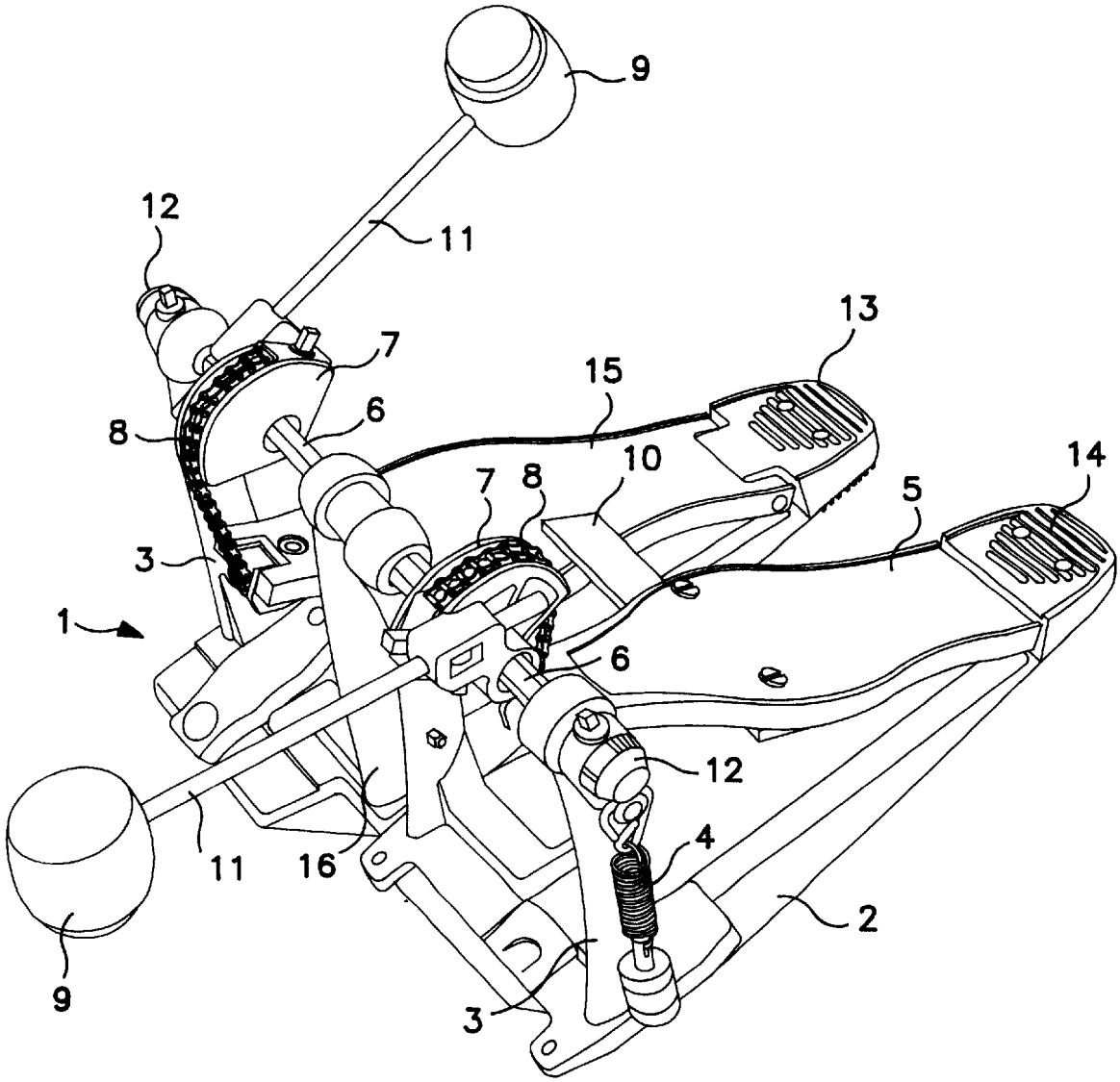
FIG. 1 is a top perspective view showing the features of the present invention.
Figure 2:
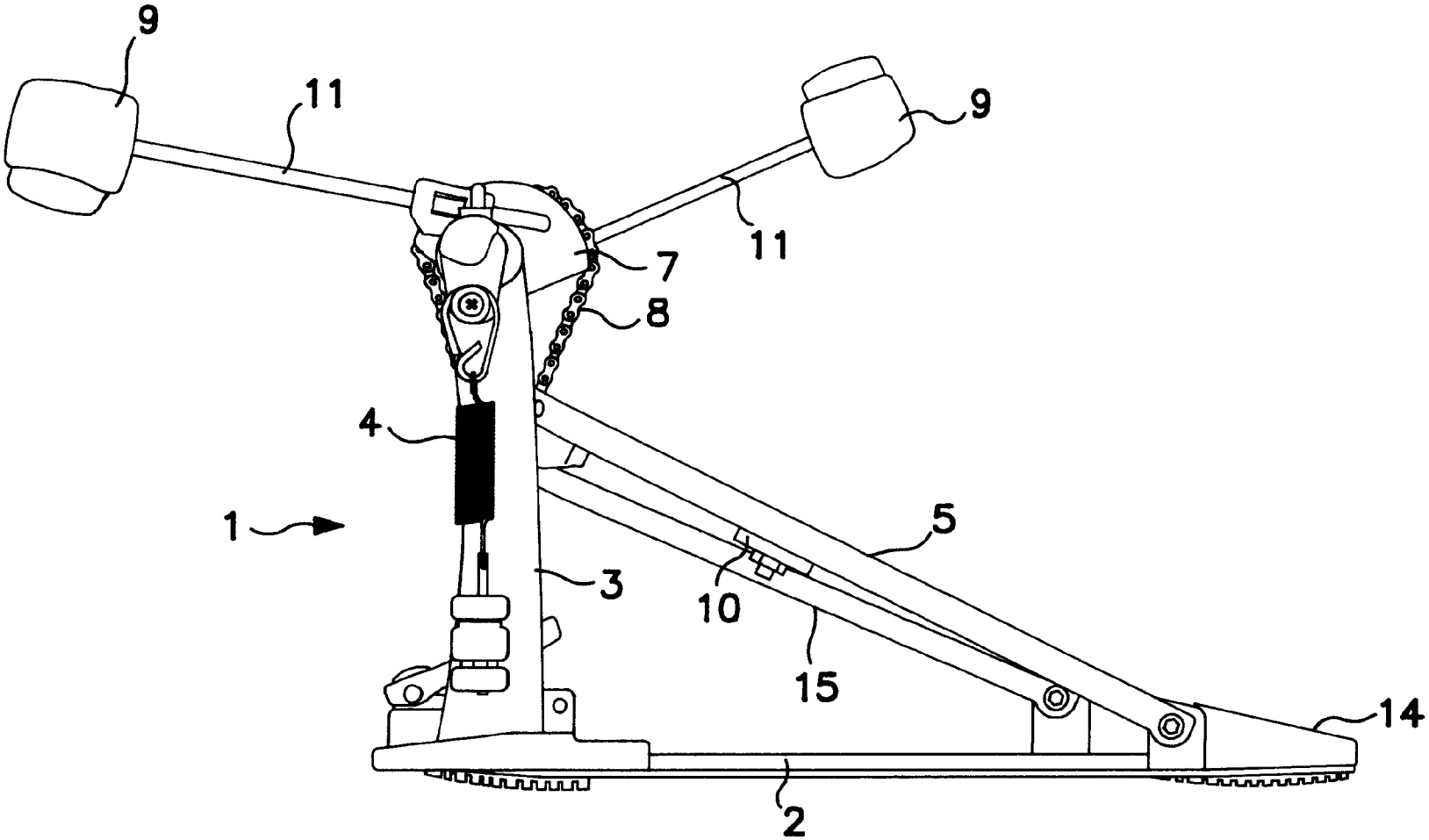
FIG. 2 is a plan view of the present device showing the required position of the mallets when the device is at rest.
Figure 3:
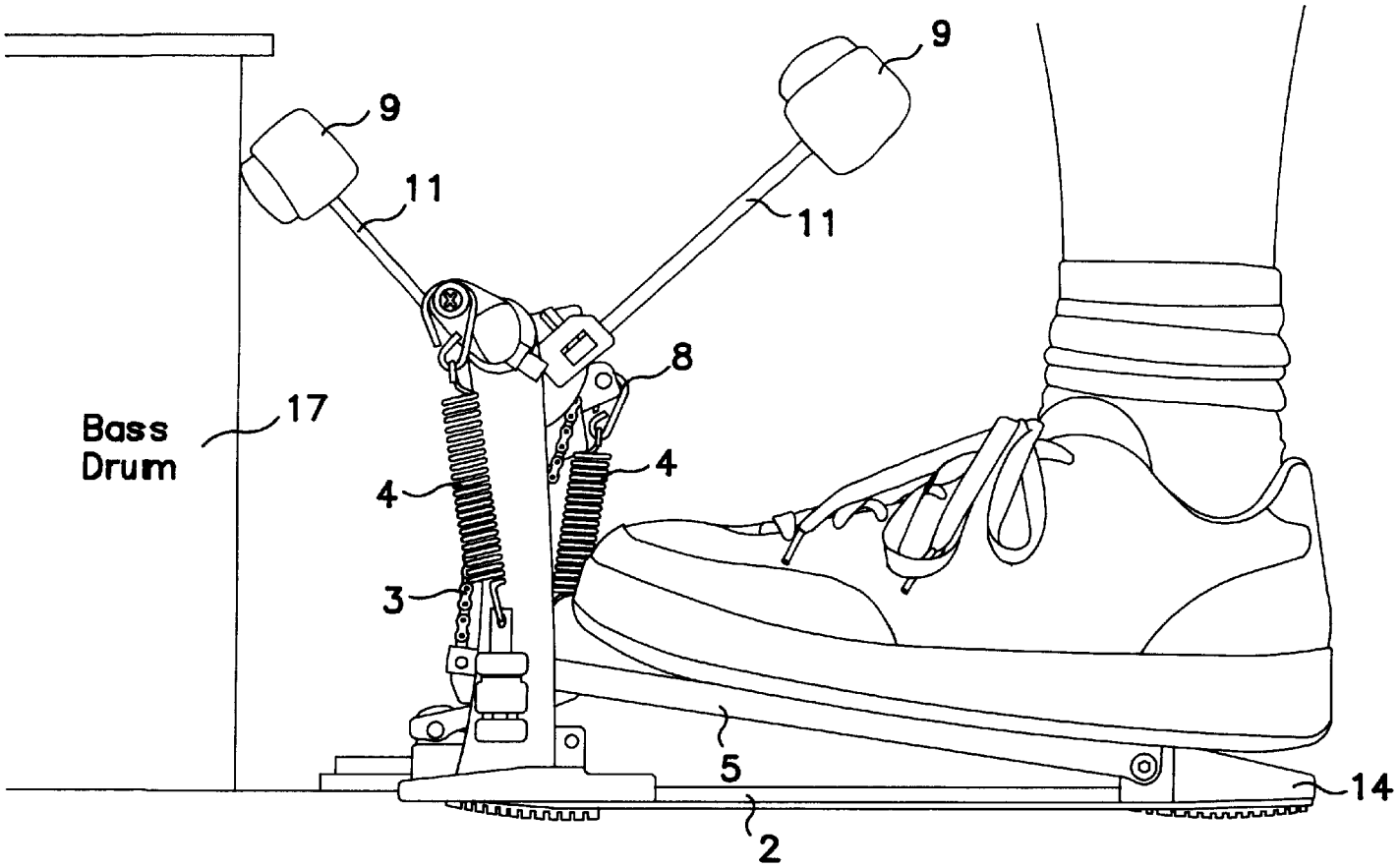
FIG. 3 is a perspective view showing the depression of one pedal which automatically depresses the second adjacent pedal to activate both mallets.
Figure 4:
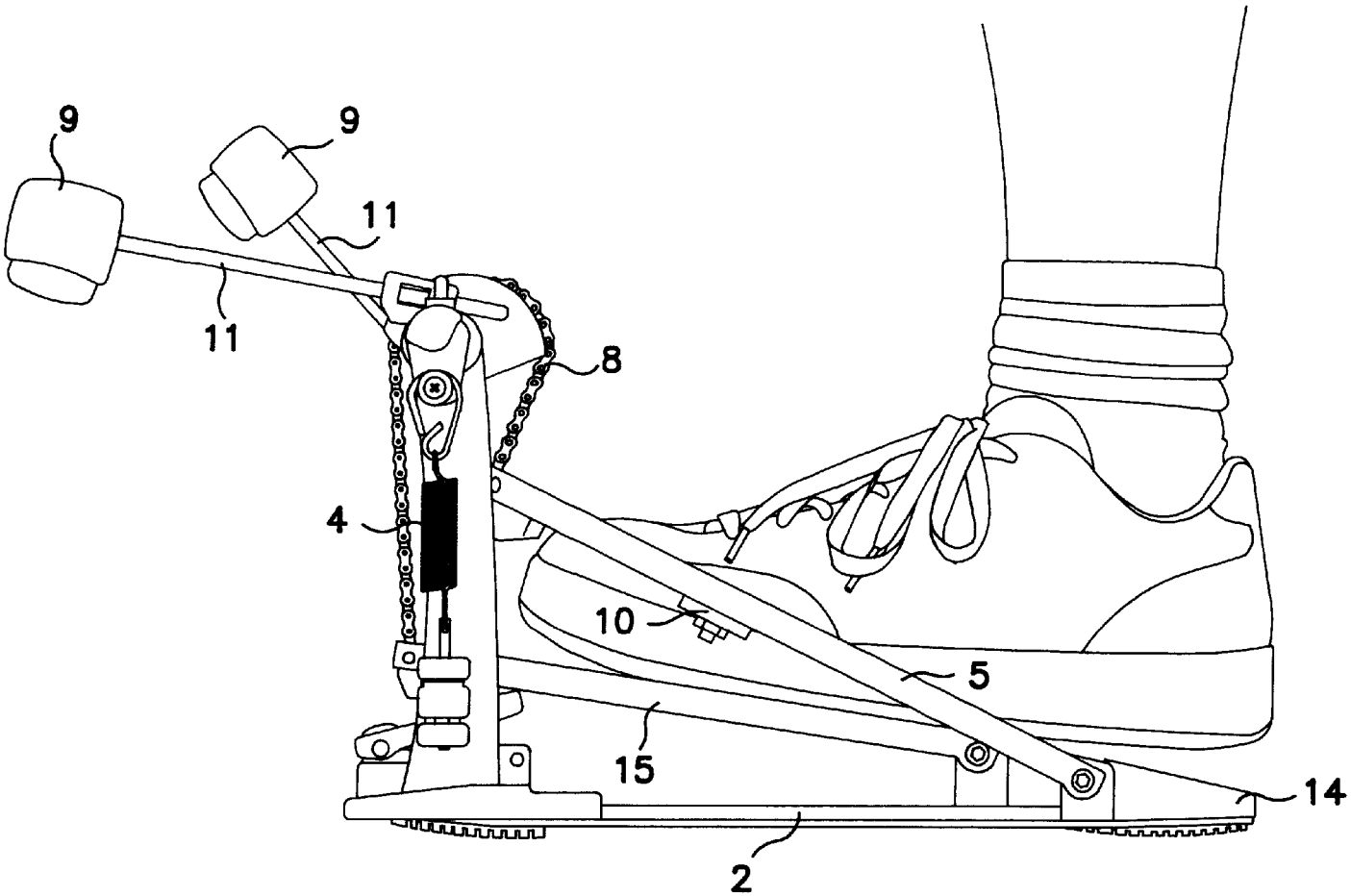
FIG. 4 is a perspective view showing the depression of only one pedal thereby activating only one mallet.

In FIGS. 1 and 2 the instrument beater apparatus 1 is shown having a base support 2 with two vertical supports 3 located on each end of base 2. Attached to each vertical support 3 is a spring 4 which permits easy pressure movement of pedals 5 and 15 when pressure is exerted thereon. A rod 6 extends to each vertical support 3 and is movably positioned there across. Around the rod 6 are two sprockets 7, each having a bicycle type chain 8 movably connected thereto. The front part of each pedal 5 and 15 is connected to the bike chain 8 and as pedals 5 and 15 are depressed, the chain 8 rotates around sprockets 7, thereby causing mallets 9, which are attached to sprocket 7 to move forward. One full foot pedal 5 has attached thereto a connecting bar 10, which extends over a portion of the adjacent foot pedal 15 so that when foot pedal 5 is pushed down, bar 10 applies pressure to pedal 15 causing pedal 15 to also be pushed down. When both pedals 5 and 15 are depressed, connected mallets 9 will both strike the drum head at intervals to create a double bass effect. For a single bass effect only pedal 15 is depressed thereby causing only one mallet 9 to strike the drum head. It can be seen how simple operation of the device of this invention is by the use of a single foot. The pedals 5 and 15 are offset from each other by at least 100°. This is important because a closer offset would cause overlap of sounds by each mallet 9 and would not provide a definite singular sound for each mallet strike. Since the mallets 9 are offset by at least about 100° better control with more distinctive individual mallet sound is achieved without muffling out of one strike because of overlap with the second strike. The mallets 9 are constructed of conventional materials, such as molded plastic, rubber, composite materials, or any other suitable conventional material. The mallets 9 are each connected to removable poles 11, which arc removably secured into sprockets 7. When the mallets 9 become worn, they are easily replaced by removing poles 11 from the sprockets 7 and replacing them with new mallets. Securing nuts 12 hold horizontal rod 6 in place and a center vertical support 16 may be used to give better strength and stability to the device. Hinged foot pedal portions 13 and 14 may be used for more comfortable usage of pedals 5 and 15. Means may be used to connect apparatus 1 to the drum rim or other portions. In FIG. 2 notice the required offset positions of the mallets 9 when the device 1 is at rest. FIGS. 3 and 4 show the feature of depressing pedal 5 (connecting pedal) to depress both pedals 5 and 15 thereby causing the two mallets 9 to strike the drumhead. In FIG. 4 only pedal 15 is depressed causing only one mallet 9 to hit the drum head.

In FIGS. 3 and 4, when pedal 5 is pushed down in FIG. 3 by the user, both mallets 9 are actuated since the connecting bar 10 forces pedal 15 down and actuates the mallet 9 connected to pedal 15, thus both mallets hit the bass drum face 17. In FIG. 4, when only pedal 15 is pushed down by the user only the mallet 9 connected to pedal 15 will hit drum 17 while the other mallet stays in the original position.

The preferred and optimally preferred embodiments of the present invention have been described herein and shown in the accompanying drawings to illustrate the underlying principles of the invention, but it is to be understood that numerous modifications and ramifications may be made without departing from the spirit and scope of this invention.

What is claimed is:

1. A device for use with a drum to cause a single or double beat to a drum head which comprises two full foot pedals which are a first and second pedal, a mallet attached to each of said pedals, the first of said pedals having a connecting bar which overlaps over said second pedal, thereby providing means where depression of said first pedal will cause by the pressure of said connecting bar depression of said second pedal, together with said first pedal, said mallets positioned in movable connection to said pedals whereby they arc offset from each other by at least 100° in relationship to the surface of said drum head.

2. The device of claim 1 wherein said second pedal has means to be singularly depressed to thereby cause only one of said mallets to strike said drum.

3. The device of claim 1 wherein each of said pedals is spring loaded to thereby provide means for each pedal to return to its original at rest position.

4. The device of claim 1 wherein each of said pedals is movably connected to a sprocket and chain.

5. The device of claim 1 wherein said device has means for connection to a bass drum.

6. The device of claim 1 wherein said full foot pedals are positioned in said device whereby a toe portion of said pedal is raised above a flat surface and a heel portion is closer to a surface of said flat surface.

7. The device of claim 1 wherein each of said mallets is mounted on removable poles.

8. The device of claim 1 wherein a toe portion of each of said pedals is movably attached to a chain and sprocket.

9. The device of claim 1 wherein each of said foot pedals is suspended from a rod which extends horizontally across said device.

10. A drum base pedal stand device having means to be aligned to a bass drum, comprising two pedals, two mallets, each connected to one of said pedals, each of said pedals having means that by pressing on one first pedal would cause both of said mallets to strike said drum, and means by pressing on a second pedal which would cause only one of said mallets to strike said drum, a connecting bar attached to said first pedal which overlaps over said second pedal thereby providing said means for depression of both pedals upon pressure on said first pedal.

11. The device of claim 10 wherein said second pedal has means to be singularly depressed to thereby cause only one of said mallets to strike said drum.

12. The device of claim 10 wherein each of said pedals is spring loaded to thereby provide means for each pedal to return to its original at rest position.

13. The device of claim 10 wherein each of said pedals is movably connected to a sprocket and chain.

14. The device of claim 10 wherein said device has means for connection to a bass drum.

15. The device of claim 10 wherein said full foot pedals are positioned in said device whereby a toe portion of said pedal is raised above a flat surface and a heel portion is closer to a surface of said flat surface.

16. The device of claim 10 wherein each of said mallets is mounted on removable poles.

17. The device of claim 10 wherein a toe portion of each of said pedals is movably attached to a chain and sprocket.

18. The device of claim 10 wherein each of said foot pedals is suspended from a rod which extends horizontally across said device.

* * * * *